US005720059A

United States Patent [19]

Allevato et al.

[11] Patent Number: 5,720,059

[45] Date of Patent: Feb. 24, 1998

[54] TILTING MECHANISM FOR BED

[75] Inventors: Eugene F. Allevato, Burlington; Jan W. Kuypers, Toronto, both of Canada

[73] Assignee: M.C. Healthcare Products Inc., Beamsville, Canada

[21] Appl. No.: 527,618

[22] Filed: Sep. 13, 1995

[51] Int. Cl.[6] ..... A47B 7/00

[52] U.S. Cl. ..... 5/610; 5/611

[58] Field of Search ..... 5/610, 611, 11

[56] References Cited

U.S. PATENT DOCUMENTS

| | | | |
|---|---|---|---|
| 2,177,808 | 10/1939 | Pohl | 5/610 |
| 3,222,693 | 12/1965 | Pruim | 5/610 |
| 3,711,876 | 1/1973 | Kirkland | 5/610 |
| 3,797,052 | 3/1974 | Licina | 5/610 |
| 5,136,742 | 8/1992 | Stebbins | 5/610 |

FOREIGN PATENT DOCUMENTS

| | | | |
|---|---|---|---|
| 250423 | 3/1964 | Australia | 5/610 |

*Primary Examiner*—Flemming Saether
*Attorney, Agent, or Firm*—Rogers & Scott

[57] ABSTRACT

The invention provides an institutional bed having a mattress frame which can be moved vertically between raised and lowered positions and which can be moved from the lowered position into one of the Trendelenberg or tilted positions. The mattress is supported on an elevating mechanism having pivots trapped in adjustable pivot sets which are mounted at ends of a connecting element. This element is moveable longitudinally of the mattress frame by an actuator to elevate the bed. Each pivot set can be released individually with the mattress frame lowered and the actuator can then be operated to tilt the mattress frame depending on which pivot set was released.

5 Claims, 5 Drawing Sheets

TILTING MECHANISM FOR BED

FIELD OF THE INVENTION

This invention relates to institutional beds of the type which includes provision to change the elevation of a mattress frame and also to tilt the mattress frame longitudinally to place the foot end of the mattress frame either above or below the head end.

BACKGROUND OF THE INVENTION

Institutional beds are the type used in hospitals and long term care facilities where the patient may require procedures where the procedure can best be carried out with the patient positioned at a selected elevation to minimize stresses on the nurses and staff providing the service. Also, some patients have conditions which require nursing with the bed inclined either to bring the foot end above the head end or conversely, to bring the foot end below the head end. These tilted positions are commonly referred to as the "Trendelenberg" positions.

Mattress frames on institutional beds have been elevated using a variety of mechanisms but the most common currently is a parallel linkage which consists of two pairs of swing arms connecting the mattress frame to a base. The swing arms are controlled by cranks through an actuator so that the user can operate the actuator and raise or lower the mattress frame.

Although the parallel linkage gives a very simple way of elevating the bed and a controlled positive position, it suffers from the disadvantage that it is not simple to incorporate structure to move the bed into Trendelenberg positions. The present invention is intended to overcome this disadvantage and to provide a simple effective structure which takes advantage of the parallel linkage approach for simple elevation, and which permits conversion to Trendelenberg positions.

SUMMARY OF THE INVENTION

The invention provides an institutional bed having a mattress frame which can be moved vertically between raised and lowered positions and which can be moved from the lowered position into one of the Trendelenberg or tilted positions. The mattress is supported on an elevating mechanism having pivots trapped in adjustable pivot sets which are mounted at ends of a connecting element. This element is moveable longitudinally of the mattress frame by an actuator to elevate the bed. Each pivot set can be released individually with the mattress frame lowered and the actuator can then be operated to tilt the mattress frame depending on which pivot set was released.

Accordingly, in one of its aspects, the invention provides an adjustable bed having a base including a pair of lower side rails extending longitudinally along the length of the bed. A mattress frame having a pair of upper side rails extending longitudinally is supported from the base by an elevating mechanism which is operable both to change the elevation of the mattress frame between raised and lowered positions and also to tilt the mattress frame to change the longitudinal inclination of the frame. The elevating mechanism includes first and second crank sets, the crank sets having pairs of swing arms pivotally connected to the mattress frame and to the base. A pair of sliding pivot assemblies are mounted on the lower side rails and the swing arms of the second crank set are pivotally attached to respective ones of the sliding pivot assemblies for longitudinal movement on the lower side rails as the mattress frame is tilted. Each of the crank sets includes cranks fixedly connected to the respective pairs of swing arms and the elevating mechanism further includes a connecting element having a pair of adjustable pivot sets coupled one to each of the cranks for pivotal movement of the cranks as the bed is adjusted. An actuator extends between the mattress frame and the connecting element for moving the element longitudinally to thereby move the crank sets and swing arms to adjust the position of the mattress frame. The swing arms and cranks are arranged to be at a common angle with the horizontal when moving the mattress frame vertically and each of the adjustable pivot sets includes a pivot pin coupled to a respective one of the cranks. A releasable hook latch is forced to engage the pin when the mattress frame is elevated to maintain the longitudinal separation between the pivot pins. Feet are coupled to the underside of the mattress frame and adapted for engagement with the floor when the mattress frame is in the lowered position so that the actuator can be used to reverse the forces between the respective pivot pins and latches by moving the feet firmly into engagement with the floor. A pair of tilt controls are coupled one to each of the latches for operation after the feet are engaged with the floor to release a selected one of the latches so that the actuator can be used to move the mattress frame into a tilted position. The direction of tilt is dependent upon which of the tilt controls is activated.

DETAILED DESCRIPTION OF A PREFERRED EMBODIMENT

Figure 1:
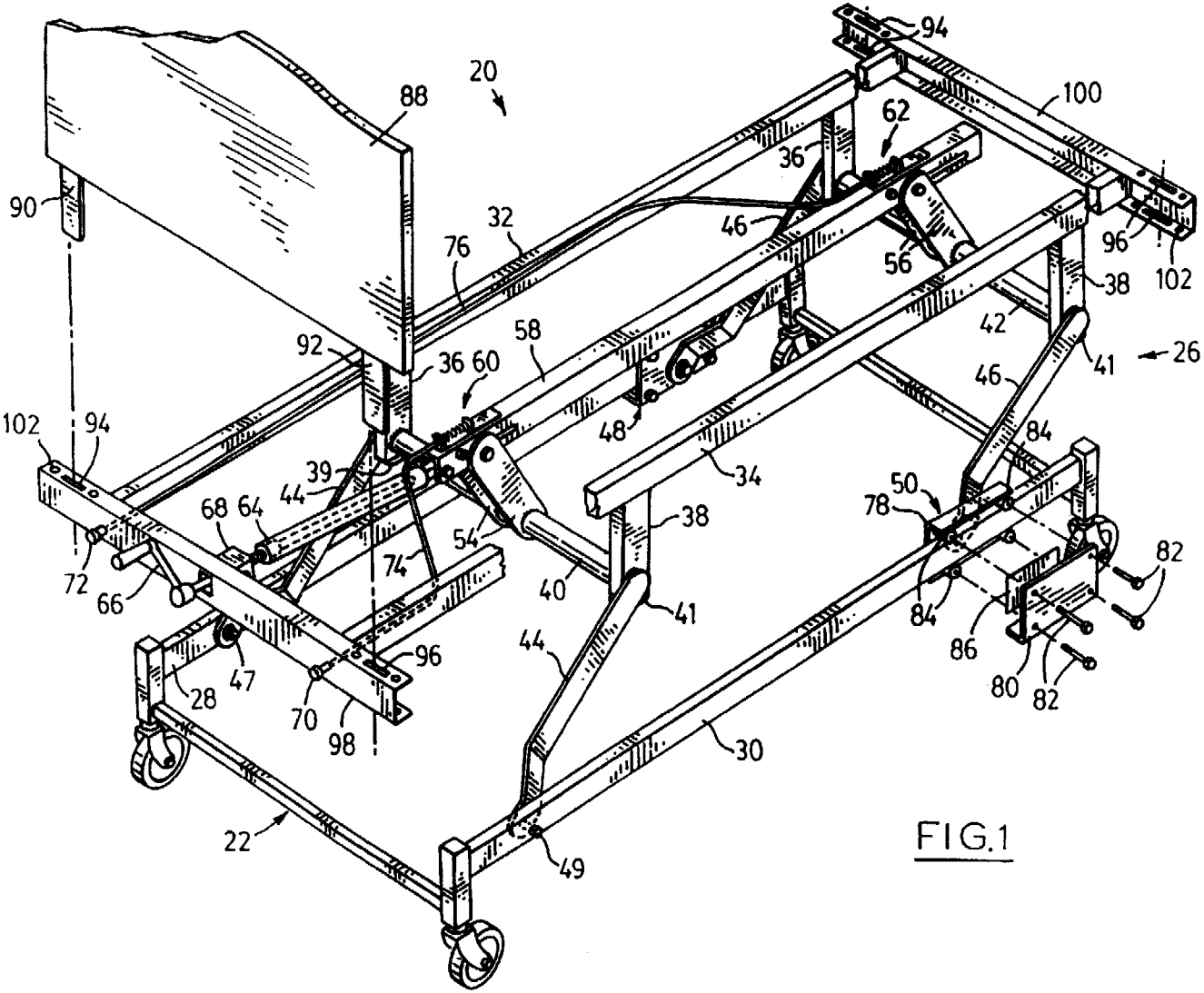
FIG. 1 is a perspective view of the essential elements of an adjustable bed with portions broken away for clarity and incorporating a preferred embodiment of the invention.

Reference is first made to FIG. 1 which illustrates a hospital bed designated generally by the numeral 20 and drawn with the foot end foremost. The bed consists essentially of a base 22, a mattress frame 24, and an elevating mechanism 26 operable to change the elevation of the mattress frame and also to tilt the mattress frame to move the head end above the foot end and vice versa.

The base includes a pair of lower side rails 28, 30 and the frame includes upper side rails 32, 34. The upper rails are attached to pairs of legs 36, 38 and transverse shafts 40, 42 are journaled in these legs. Outer ends of the shafts are rigidly attached to respective pairs of swing arms 44, 46 which are arranged so that they maintain a common angle with the horizonal thereby acting in unison in the generally parallelogram arrangement.

The bottom ends of the swing arms 44 are pivotally mounted on the respective lower side rails 28, 30 at pivots 47, 49 whereas the lower ends of the swing arms 46 are pivotally mounted on respective sliding pivot assemblies 48, 50.

The sliding pivot assemblies 48, 50 permit the distance between pivots 47, 49 and the sliding pivot assemblies 48, 50 to vary. This is necessary when the mattress frame 24 is tilted, as will be described with reference to FIGS. 2 to 5.

The swing arms 44, 46 are maintained in a common angular relationship with the horizontal by respective pairs of cranks 54, 56 set centrally on the shafts 40, 42 which in turn are attached to the swing arms 44, 46. The resulting crank sets are maintained in relationship one with the other, by a connecting element 58 coupled to the crank sets by adjustable pivot sets 60, 62. These pivot sets will be described more fully with reference to subsequent drawings, but for the moment it is sufficient to explain that one or the other of the pivot sets can be activated so that the crank sets no longer remain in the same common orientation to the horizontal. The result is that depending upon which of the pivot sets is released, the mattress frame 24 will fall out of parallelism with the base 22 and tilt in a controlled fashion.

The relationship between the elevating mechanism 26 and the mattress frame 24 is maintained by an actuator 64 operable by a manual crank 66 mounted in an anchor 68 on the mattress frame. As a result, when the manual crank 66 is rotated in one direction, the connecting element will move from the foot end containing the crank 66 towards the head end of the bed. This will cause the mattress frame to be lowered. On reversing the manual crank, the connecting element 58 will be drawn towards the foot end of the bed resulting in elevation of the mattress frame relative to the base 22. While this is occurring, the crank sets will remain in the same relative orientation with respect to the horizontal and the distance between the pivots 47, 49 in the lower side rails 28, 30 to the sliding pivot assemblies 48, 50 will remain constant.

As will be described, if the bed is to be tilted, it must first be moved downwardly into a lowered position in order to operate a selected one of a pair of tilt controls 70, 72 which are connected via respective sheathed cables 74, 76 to the respective adjustable pivot sets 60, 62.

As mentioned previously, in order to permit tilting, the sliding pivot assemblies 48, 50 will move on the lower side rails 28, 30. The pivot assembly 50 is typical of both assemblies and includes inner and outer plates 78, 80 which are both L-shaped in section to define a box held together by a series of set screws 82 which pass through rollers 84 positioned to ride on the respective top and bottom of the side rail 30. In order to minimize the risk of marking this rail, each of the plates 78, 80 contains a pad 86 of plastics material to slide on the side rail. The result is a very stable structure with low frictional resistance and which will move without damaging the rail 30.

FIG. 1 also illustrates a simplified footboard 88 which is typical also of a headboard and which is omitted for simplicity. The footboard 88 has a pair of downwardly projecting tongues 90, 92 proportioned to fit in slots 94, 96 provided for the purpose. These slots appear in both the top and bottom flanges of a U-shaped end element 98 of the mattress frame 24. A similar end element 100 is provided at the head end and the slots can be seen more clearly in that view.

The end elements 98, 100 also include openings such as the opening 102 for use in connecting various medical devices to the bed for as needed by the patient.

Reference will next be made to FIGS. 2 to 5 in sequence to describe the actions of raising and lower the mattress frame and also tilting the mattress frame. These views will be described generally to indicate the various movements, and then revisited after describing details of the structure with reference to FIGS. 6 to 8.

Figure 2:
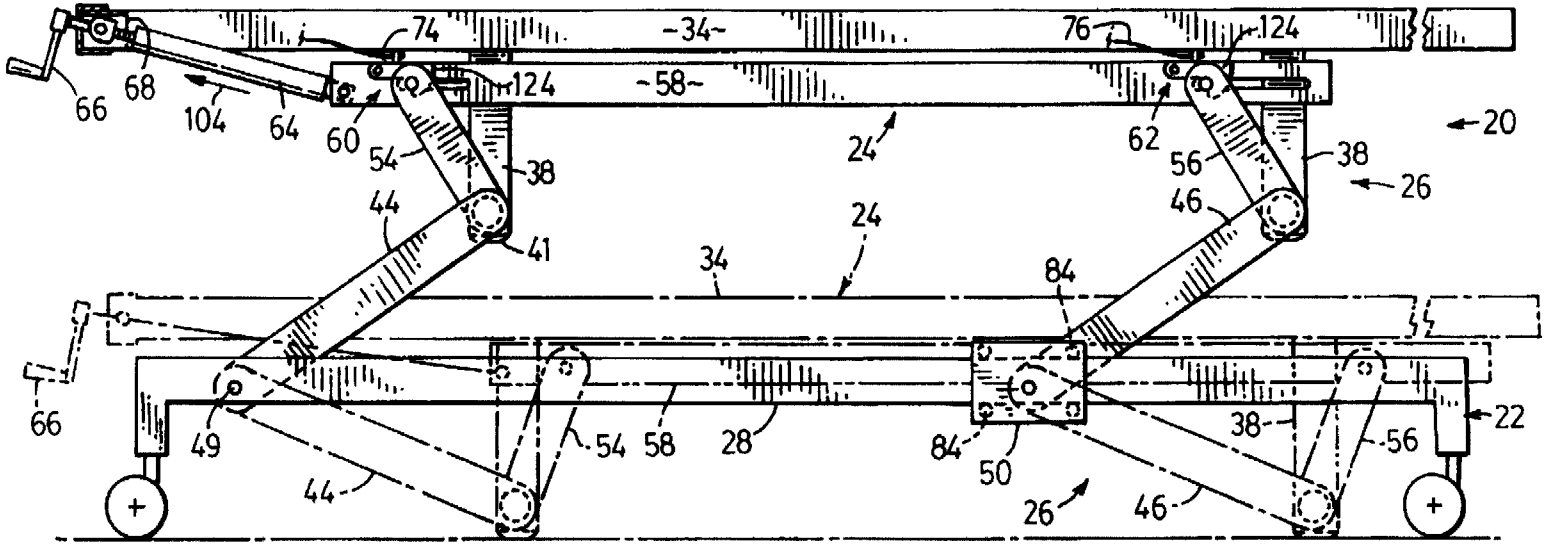
FIG. 2 is a somewhat diagrammatic side view of the bed showing the mattress frame in a fully elevated position above a base, and in ghost outline, the mattress frame in a lowered position.

As seen in FIG. 2, the mattress frame 24 is in the raised position in full outline and in the lowered position in ghost outline. In the full outline position the load of the mattress frame tends to rotate the swing arms 44, 46 in a clockwise direction as drawn. This will result in the cranks 54, 56 being biased to move in a clockwise direction also. This movement is resisted by the adjustable pivot sets 60, 62 so that the common angular relationship of the swing arms 44, 46 and the similar relationship between the cranks 54, 56 is maintained as the mattress frame is moved from the raised position to the lowered position.

In the arrangement shown in FIG. 2 in full outline, the actuator 64 is providing a force in the direction of the arrow 104 in reaction to the gravitational force which will tend to lower the mattress frame 24 towards the base 22. This arrangement of forces will continue until such time as the feet 39, 41 (FIG. 1) contact the ground. At that point there will be no force acting on the actuator and consequently if the actuator is rotated in the same direction that was used to lower the mattress frame 24, the actuator will tend to drive the mattress frame into the ground with the result that it would tend to lift the base 22. As a result, the force applied by the actuator is now in the direction of the arrow 106 shown in FIG. 3. This will effectively push the connecting element 58 longitudinally and, as will be described, this releases the adjustable pivot sets 60, 62. A selected one of the tilt controls 70, 72 (FIG. 1) can then be actuated to hold the selected pivot set in the released position to permit the manual crank to be reversed into an elevating mode, and the bed will then move into a tilt as will now be described. It should be noted that when the mattress frame is elevated the pivot sets are locked by the downward load and can not be released in normal use.

Figure 3:
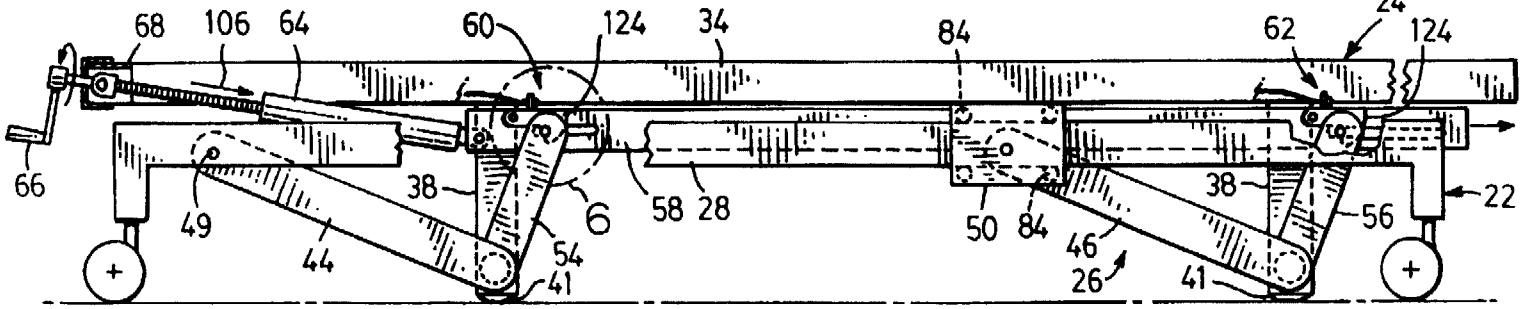
FIG. 3 is a view similar to FIG. 2 and illustrating the initial movements in tilting the mattress frame relative to the base.
Figure 4:
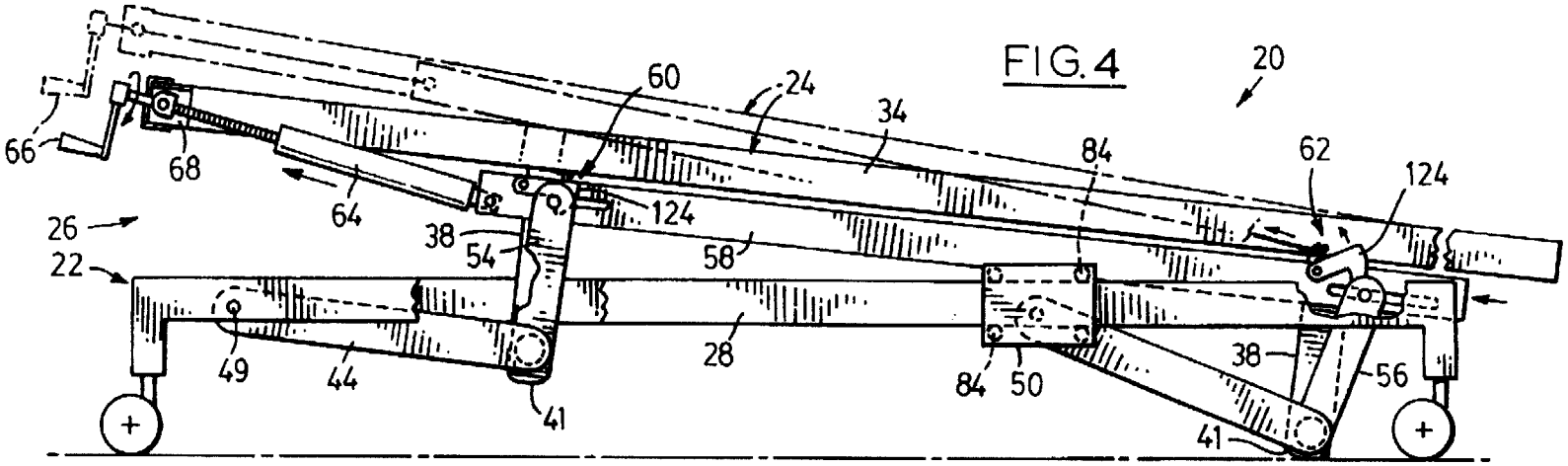
FIG. 4 is a view similar to FIG. 3 showing the mattress frame tilted with the foot of the bed above the head, and in ghost outline, a full degree of tilt in this direction.

Reference is next made to FIG. 4 which illustrates the bed 20 in tilt position. This is achieved by starting with the bed in the FIG. 3 position, driving the actuator slightly so that the adjustable pivot sets 60, 62 will release, and pulling the tilt control 72 to maintain the pivot set 62 in a released position. It is necessary to hold the tilt control 72 momentarily while reversing the direction of the manual crank 66 to start to elevate the bed. As soon as initial elevation is achieved, the tilt control 72 can be released because the adjustable pivot set is in a permanently released position as will be described later. As soon as elevation commences, the adjustable pivot set 60 is again in the locked position where it was during normal elevation of the bed. Consequently the user can now operate the actuator 64 until it reaches its full extent and during this motion the pivot set 62 adjusts as does the sliding pivot assembly 50 on the lower side rail 28. At the foot end of the bed, the swing arms 44 and associated parts of this crank set will remain in the relationship that they occupied in FIGS. 2 and 3. The result is that the bed will tilt as shown in FIG. 4 and maximum tilt is achieved in the ghost outline position as will be further described with reference to FIGS. 6 and 7.

Figure 5:
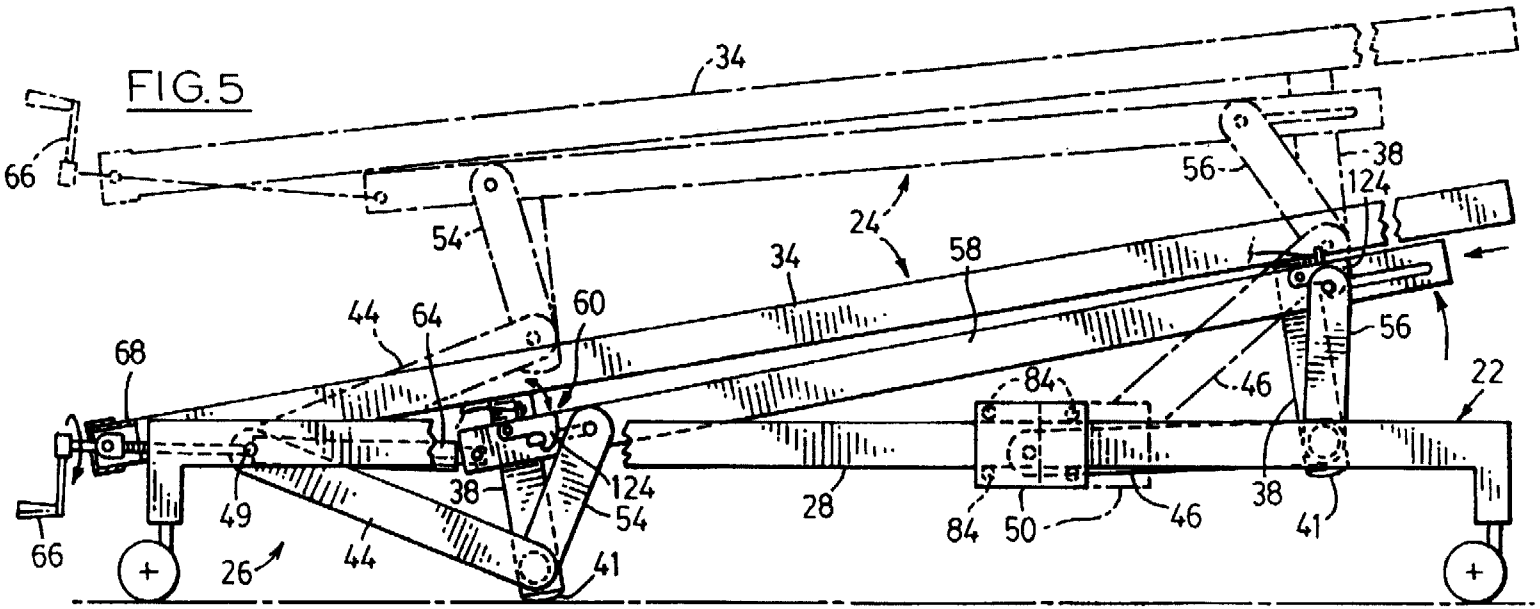
FIG. 5 is a view similar to FIG. 3 and showing the tilt with the foot below the head, and also illustrating in ghost outline the mattress frame both tilted and elevated.

A comparison of FIGS. 4 and 5 will show that if the tilt control 70 is operated instead of the tilt control 72, then the opposite tilt will be achieved. FIG. 5 also shows that once the maximum tilt is achieved, the mattress frame can be elevated while maintaining tilt. There will be some variation in the tilt due to the nature of the linkages but nevertheless the tilt is essentially maintained throughout the vertical travel of the mattress frame.

Details of the adjustable pivot sets 60, 62 shown in the previous drawings will now be described with reference to FIG. 6 and further details of the operation of these pivot sets will then be described with reference again to FIGS. 2 to 5.

Figure 6:
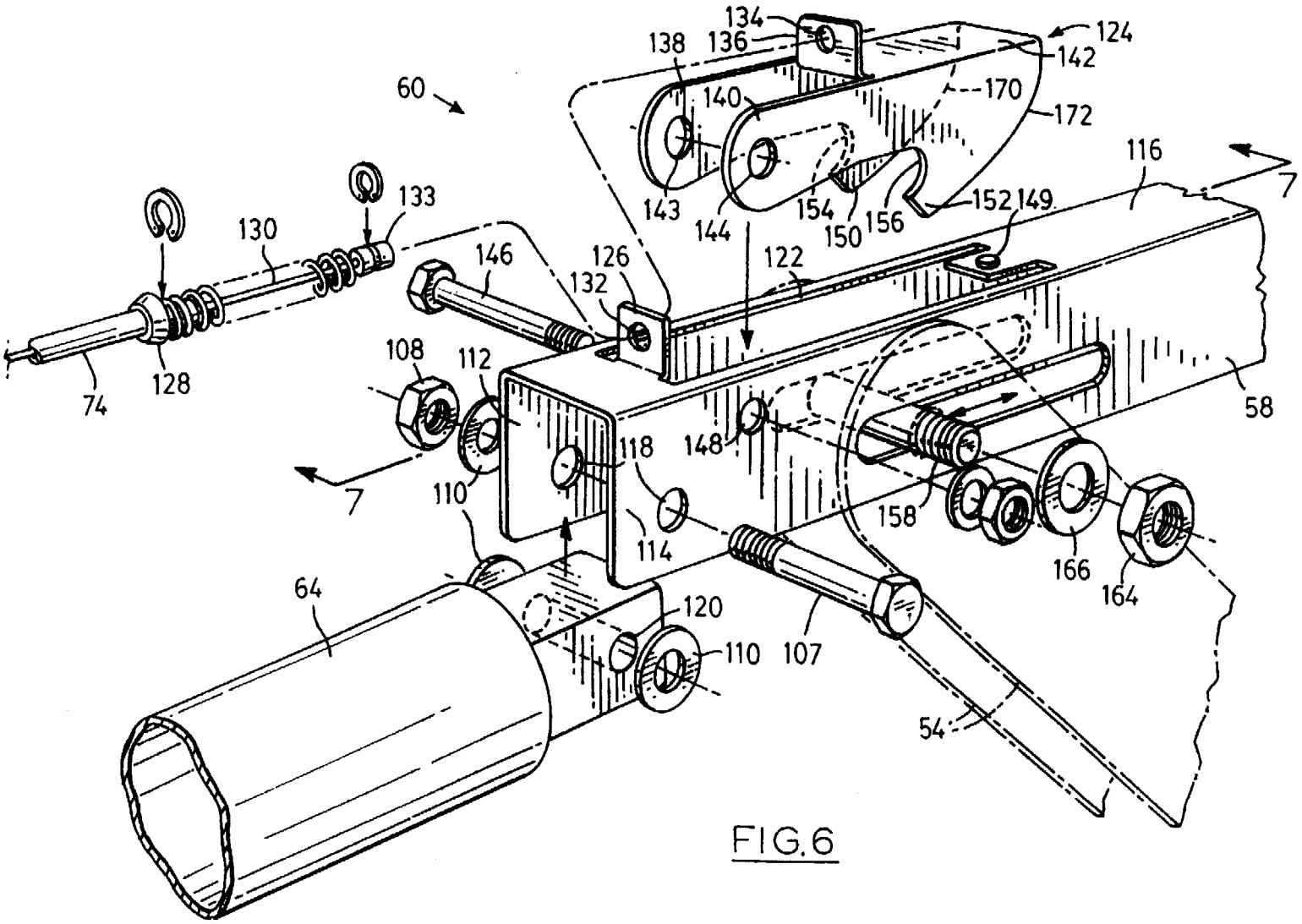
FIG. 6 is an enlarged exploded perspective view of a portion of the elevating mechanism identified within a chain dotted circle in FIG. 3 and identified by the numeral 6.

FIG. 6 is an enlarged perspective and exploded view of the parts ringed and identified with the numeral 6 in FIG. 3. The pivot set 60 will be described and this pivot set is exemplary of also a pivot set 62.

Pivot set 60 is assembled at one end of the connecting element 58 which in turn is attached to the actuator 64 by a bolt 107 having a nut 108 and associated washers 110. As can be seen in FIG. 6, the connecting element 58 is an inverted U-shaped cross section having side flanges 112, 114 and a web 116. The bolt 107 passes through openings 118 formed in the flanges 112, 114 and through an opening 120 in the end of the actuator 64. This provides for a horizontal pivot so that the actuator can move vertically about this pivot in relation to the connecting element 58.

The web 116 has a cutout 122 formed to receive a hooked latch 124 having a generally U-shaped cross section. A tab 126 is raised from the web 116 adjacent the cutout 122 to provide an anchor for an end fitting 128 of the sheath forming part of the cable 74. An end portion 130 of the inner element of the cable passes through an opening 132 in the raised tab 126 so that an end anchor 133 on the inner portion can be fixed in an opening 134 in a raised tab 136 formed as part of the latch 124. Consequently operation of the tilt control 70 will result in pulling the raised tab 134 of the latch towards the raised tab 126 to elevate the latch as will be described.

The latch 124 includes first and second sides 138, 140 spaced by a spine 142 to which the tab 136 is attached. The sides 138, 140 define aligned openings 143, 144 to receive a pivot bolt 146 which passes through a pair of openings 148 (one of which is seen) in the flanges 112, 114 of the connecting element 58 to permit the latch 124 to fall freely into engagement with a cushioned stop 149.

The sides 138, 140 of the latch 124 also define a pair of similar downwardly projecting hooks 150, 152. These hooks have circular recesses 154, 156 shaped to fit closely about a pivot pin 158 which passes through the cranks 54 and is housed in a pair of parallel slots 160, 162 formed in the respective flanges 112, 114 of the connecting element 58. A limited length of thread is provided on the pivot pin 158 so that when a nut 164 is tightened on the thread, the associated washer 166 will bear lightly against the cranks 54 to ensure that the cranks can slide in relation to the element 58 guided by the pivot pin 158. When these parts are assembled, they appear as shown to a smaller scale in FIG. 7.

Figure 7:
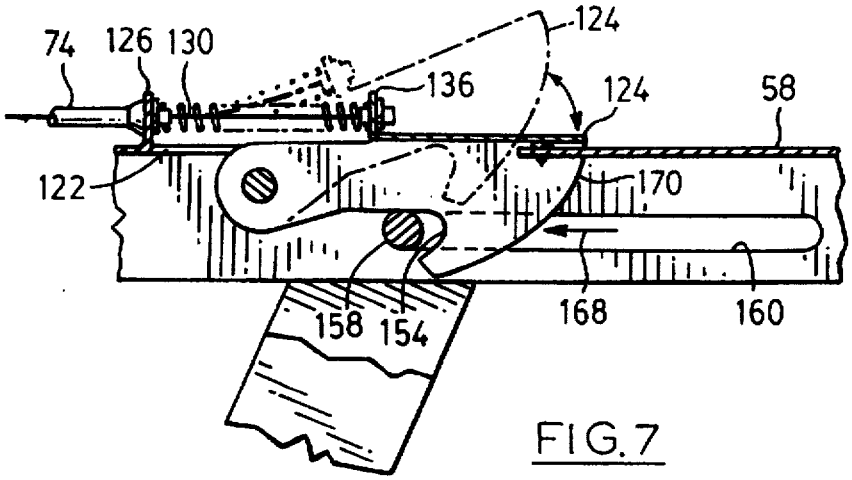
FIG. 7 is a side view of the parts shown in FIG. 6 in an assembled condition.

Reference is now made to FIG. 7 which is a sectional view on line 7—7 of FIG. 6. The assembly is shown in the position it would occupy when the bed is in the position shown in FIG. 3. In other words, the actuator has driven the mattress frame downwardly to bring the feet 41 (FIG. 3) firmly into engagement with the floor. This reverses the forces and the connecting element 58 has been driven slightly to the right as drawn in FIG. 7. As a result, the locking latch 124 has been carried by the element 58 to the right with reference to the pivot pin 158 thereby clearing the latch from the pin and into a position where it can be moved into the ghost outline position shown in FIG. 7. As mentioned previously, this is achieved by operating the tilt control 70 (FIG. 1) to draw the raised tab 136 on the latch towards the tab 126 on the element 58. With the latch in the ghost outline position, clearly the pivot pin 158 can be driven along the slot 160 whereas when the latch is in the locked position shown in full outline, the pin 158 will be trapped within the recess 154 provided for the purpose. When the pin is in that position, the shape of the hook is such that force applied by the pin to the latch is insufficient to cause the latch to move upwardly. Consequently the latch is a locking latch holding the pin in place. However, if the pin is at the other end of the slot, and is driven towards the latch, it will travel along the direction of the arrow 168 and meet a pair of inclined and rounded edges 170 and 172 (seen in FIG. 6). The action is such that the movement of the pivot pin 158 will deflect the latch upwardly allowing the pin to pass to regain its position within the hooked portion 154. As soon as the actuator is operated to elevate the bed, the pin will be trapped by the latch as previously described.

Figure 8:
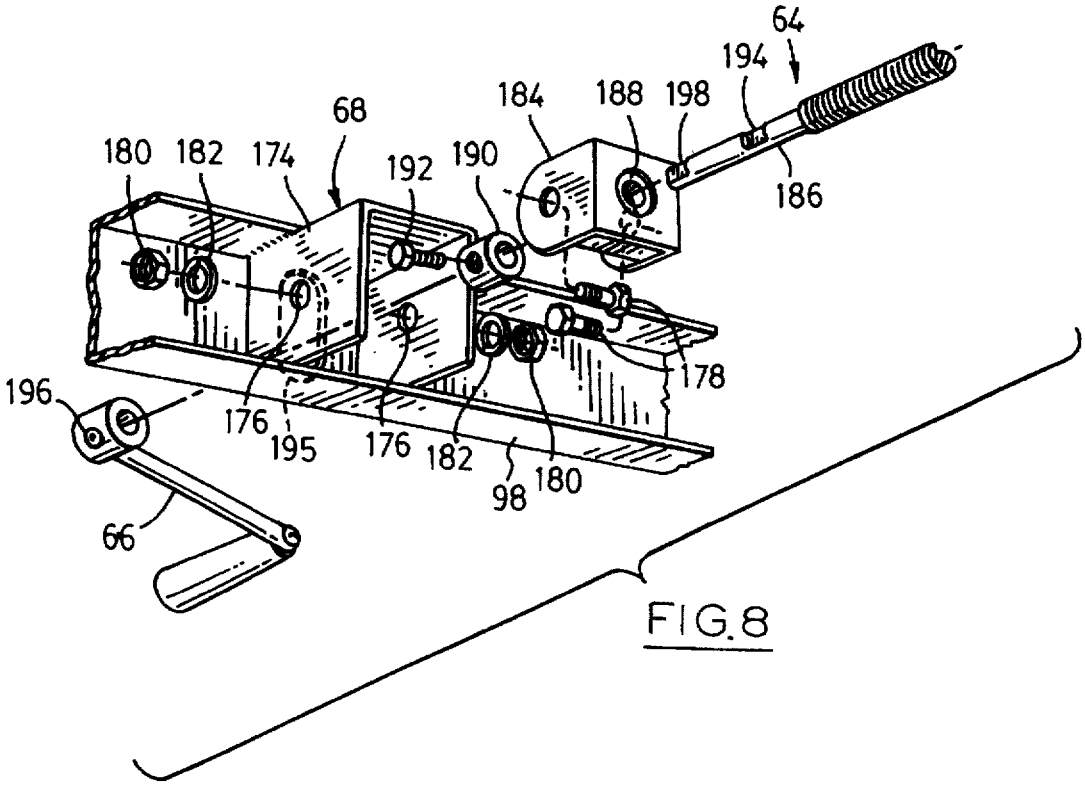
FIG. 8 is a perspective view illustrating an actuator anchor used in the elevating mechanism.

Before returning to FIGS. 2 to 5 to describe the operation of the bed in more detail, FIG. 8 will be described to complete the description of the parts. FIG. 8 is an exploded perspective view showing the anchor 68 in FIG. 1 in more detail. As seen in FIG. 1, the anchor is mounted on the end element 98 of the mattress frame. A bracket 174 is welded inside the end element 98 to define a pair of openings 176 to receive a pair of bolts 178 which combine with nuts and washers 180, 182 to retain a trunnion 184 loosely inside the bracket 174. An end of a threaded shaft 186 of the actuator passes through an opening 188 in the trunnion 184 and receives a sleeve 190 having a threaded opening for a set screw 192 which can be threadably engaged with the sleeve in place on a flat portion 194 to lock the shaft 186 in the trunnion 184 while permitting the shaft to rotate.

When the trunnion is assembled with the shaft 186 in place, an end of the shaft projects through an oversize opening 195 in the end element 98 to receive the manual crank 66 which is attached to the shaft 186 by a set screw 196 applied to a flat 198 at the end of the shaft 186. With the assembly in place, rotation of the manual crank 66 will carry the shaft 186 which is free to turn within the trunnion. As the actuator changes its angular position along a vertical plane, the trunnion permits this movement and the oversize opening 195 ensures that there is no interference as this tilt takes place.

Reference is again made to FIGS. 2 to 6 to describe details of the structures. In the position shown in FIG. 2, the pivot sets 60, 62 are locked with the latches 124 in firm engagement with the pivot pins. All of the loading is forcing the pivot pins into the latches so that there is a positive location of the mattress and there is also a positive location of the mattress frame 24 vertically with respect to the base 22.

In FIG. 3, and as explained previously, the forces are about to be reversed as the feet 41 meet the floor. In FIG. 4, the forces have been reversed and the actuator is now moving the bed into a tilt position.

As seen in FIG. 4, the mattress frame 24 has been elevated from the FIG. 3 position after the tilt control 72 has been operated to release the adjustable pivot set 62. This frees the pivot pin from the locking latch and allows the pin to move down the associated slots in the connecting element 58. Horizontal adjustment is provided on the lower side rails by the sliding pivot assemblies 48, 50 which are free to move on these rails as previously described. Consequently as the actuator is operated, the adjustable pivot set 60 remains in a locked position similar to when the bed is being simply elevated, whereas the adjustable pivot set 62 allows movement without elevation. This continues to a maximum position shown in ghost outline.

The comparison between FIGS. 4 and 5 will show that if the tilt control 70 had been operated from the FIG. 3 position instead of the control 72, then the bed would tilt in the opposite direction which is seen in FIG. 5. However FIG. 5 illustrates a further possibility. As the tilt continues, then the pivot pin associated with the adjustable pivot set 60 will reach the end of associated slots and can move no further. It is then effectively locked and because the pivot pin in the pivot set 62 is locked by the associated latch, further movement of the actuator will result in elevation of the mattress 24 in the tilted position. This can also be done from the FIG. 4 position to elevate in the opposite tilt position. The lengths of the slots will determine the angle of tilt before elevation takes place.

Although as elevation takes place with the mattress frame tilted, there will be some deviation in the tilt, it will remain essentially in the same relative position to the base. This variation is illustrated by the ghost outline position in FIG. 5. The cause of this is simply the geometry of the relationships.

It will now be evident that the preferred embodiment is capable of elevating a mattress frame between lowered and raised positions and also to tilt the mattress frame into both of the Trendelenberg positions.

Variations to the preferred embodiment are within the scope of the invention as claimed.

We claim:

1. An adjustable bed for use to elevate and to tilt a patient, the bed having;

a base including a pair of lower side rails spaced apart and extending longitudinally of the bed, the base being adapted to stand on a floor;

a mattress frame having a pair of upper side rails extending longitudinally;

an elevating mechanism coupling the base and mattress frame and operable both to move the mattress frame relative to the base between raised and lowered positions, and to tilt the mattress frame longitudinally;

the elevating mechanism including first and second crank sets, the crank sets having pairs of swing arms pivotally coupled to the mattress frame and to the base, a pair of sliding pivot assemblies mounted on the lower side rails, the swing arms of the second crank set being pivotally attached to the respective sliding pivot assemblies for longitudinal movement on the lower side rails when the mattress frame is tilted;

each of the crank sets including cranks fixedly connected to the respective pairs of swing arms;

the elevating mechanism further including a connecting element having a pair of adjustable pivot sets coupled one to each of the cranks for pivotal movement of the cranks as the bed is adjusted, and an actuator extending between the mattress frame and the connecting element for moving the element longitudinally to thereby move the crank sets and swing arms to adjust the position of the mattress frame;

the swing arms and cranks being in parallel when elevating the mattress frame with the mattress frame horizontal;

each of the adjustable pivot sets including a pivot pin coupled to a respective one of the cranks with the pivot pins separated longitudinally, each of the pivot sets also including a releasable latch forced to engage the pin when the mattress frame is horizontal and elevated to maintain the longitudinal separation between the pivot pins;

feet coupled to the underside of the mattress frame and adapted to come into firm engagement with the floor when the mattress frame is moved into the lowered position so that the actuator can be used to reverse the forces which engage the respective pivot pins and latches by moving the feet firmly into engagement with the floor; and a pair of tilt controls coupled one to each of the latches and operable when the feet are engaged with the floor to release a selected one of the latches so that the actuator can be used to move the mattress frame into a tilted position, the direction of tilt being dependent on which of the tilt controls is activated.

2. An adjustable bed for use to elevate and to tilt a patient, the bed having:

a base extending longitudinally and adapted to stand on a floor;

a mattress frame above the base;

two pairs of swing arms pivotally coupled to the base and to the mattress frame for rotation to move the mattress frame relative to the base between raised and lowered positions and to tilt the mattress longitudinally;

first and second cranks fixedly attached one to each of the respective pairs of swing arms and having pivot pins at outer ends of the cranks;

a connecting element having slots containing the respective pivot pins;

an actuator extending between the mattress frame and the connecting element and operable to raise and lower the mattress frame;

a pair of hooked latches coupled to the connecting element for retaining the respective pivot pins relative to the connecting element when the mattress frame is horizontal, the weight of the mattress frame causing the pivot pins to engage firmly in the respective hooked latches;

a pair of tilt controls coupled to the respective latches;

feet on the underside of the mattress frame and adapted to come into firm engagement with the floor when the mattress frame is moved into the lowered position thereby reversing the loading between the pivot pins and the hooked latches to permit a selected one of the tilt controls to release a corresponding one of the latches so that on operating the actuator the released pivot pin will move longitudinally of the connecting element in the corresponding one of said slots to tilt the mattress frame; and a pair of sliding pivot assemblies pivotally connected to one of the pairs of parallel swing arms on the lower side rails and providing for translational movement longitudinally as the mattress frame tilts.

3. An adjustable bed for use to elevate and to tilt a patient, the bed having:

a mattress frame extending longitudinally and having feet adapted to engage the floor;

a base below the mattress frame;

two pairs of swing arms coupled to the base and to the mattress frame and operable to elevate the mattress frame relative to the base and to tilt the mattress frame;

cranks coupled one to each pair of swing arms and fixed to the swing arms, the cranks terminating in pivots;

a connecting element extending longitudinally under the mattress frame;

a pair of adjustable pivot sets coupling the pivots to the connecting element;

an actuator coupled to the mattress frame and to the connecting element and operable to move the connecting element longitudinally to rotate the cranks and to change the angular relationship between the swing arms and the horizontal to move the mattress frame between an elevated position and a lowered position in which the feet are adapted to be brought into engagement with the floor which supports the bed;

the adjustable pivot sets including latches retaining the pivots in relation to the connecting element and operable by the actuator when said feet are engaged firmly on the floor to release a selected one of the pivots so that operation of the actuator can then be used to cause different motions in the cranks and associated swing arms so that the mattress frame will tilt.

4. An adjustable bed as claimed in claim 3 in which the connecting element defines longitudinal slots containing the pivots.

5. An adjustable bed as claimed in claim 3 in which one of the pairs of swing arms is pivotally coupled to respective sliding first assemblies on the base to permit motion along the base as the mattress frame tilts.

* * * * *